US005275441A

United States Patent [19]

Claycomb

[11] Patent Number: 5,275,441

[45] Date of Patent: Jan. 4, 1994

[54] BLAST JOINT WITH TORQUE TRANSFERRING CONNECTOR

[76] Inventor: Jack R. Claycomb, 8226 Waynemer, Houston, Tex. 77040

[21] Appl. No.: 830,639

[22] Filed: Feb. 4, 1992

[51] Int. Cl.[5] ..... F16L 55/00

[52] U.S. Cl. ..... 285/45; 166/243; 166/309

[58] Field of Search ..... 285/45, 389, 323, 309, 285/308, 141; 166/243

[56] References Cited

U.S. PATENT DOCUMENTS

| | | | |
|---|---|---|---|
| 3,895,832 | 7/1975 | Ellis et al. | 285/322 |
| 4,028,796 | 6/1977 | Bergstrom | 29/416 |
| 4,141,386 | 2/1979 | Bergstrom | 138/147 |
| 4,211,440 | 7/1980 | Bergstrom | 285/45 |
| 4,349,050 | 9/1982 | Bergstrom et al. | 138/147 |
| 4,381,821 | 5/1983 | Greene, Jr. | 166/243 |
| 4,613,165 | 9/1986 | Kuhne | 285/45 |
| 4,685,518 | 8/1987 | Claycomb | 166/243 |
| 4,688,828 | 8/1987 | Shaffer | 285/45 |
| 4,726,423 | 2/1988 | Claycomb | 166/380 |
| 4,799,714 | 1/1989 | Collet | 285/308 |
| 4,889,185 | 12/1989 | Uherek et al. | 166/243 |
| 4,911,479 | 3/1990 | Claycomb | 285/39 |
| 4,915,177 | 4/1990 | Claycomb | 166/380 |
| 4,976,458 | 12/1990 | Hosie et al. | 285/141 |
| 5,016,921 | 5/1991 | Claycomb | 285/39 |
| 5,059,043 | 10/1991 | Kuhne | 166/243 |

*Primary Examiner*—Eric K. Nicholson

*Attorney, Agent, or Firm*—Pravel, Hewitt, Kimball & Krieger

[57] ABSTRACT

A blast joint resistant to erosion including an inner pipe joint having a substantially smooth outer surface and an upper end and a lower end. A cylindrical lower assembly having an exterior surface suitable for gripping with power tongs is mounted on the lower end of the inner pipe joint with a torque transfer assembly for transferring torque from the lower assembly to the smooth outer surface of the inner pipe joint. A cylindrical upper assembly having an exterior surface suitable for gripping with power tongs is mounted on the upper end of the inner pipe joint. A plurality of erosion resistant rings are concentrically mounted on the inner pipe joint in a vertically continuous arrangement from a point near the lower end to a point near the upper end of the inner pipe joint without a vertical gap between the rings. A hydrostatic piston and cylinder loader provides a vertical load on the plurality of rings to prevent separations between the rings.

12 Claims, 8 Drawing Sheets

BLAST JOINT WITH TORQUE TRANSFERRING CONNECTOR

FIELD OF THE INVENTION

This invention is in the field of blast joints suitable for service in production zones where the joint will be subjected to high speed particle impingement.

BACKGROUND OF THE INVENTION

In the drilling and production of oil and gas wells, it is frequently necessary to penetrate one or more production zones to reach an underlying zone with production tubing. Each production zone is served by its own string of production tubing which then must penetrate the overlying production zones to reach the surface. At the point where each string of production tubing penetrates an overlying production zone, the tubing can be subjected to severe erosion.

Particularly where the production zone being penetrated produces high pressure gas, abrasive materials entrained in the gas can quickly erode the surface of the production tubing penetrating that zone. High pressure gas moves at very high velocities when the zone is producing and it can contain such entrained erosive materials as grains of sand or drops of liquid. Where the high velocity gas enters the well bore, it impinges upon the penetrating production tubing from an underlying zone and, depending upon the material from which production tubing is made, the high velocity gas can quickly damage or even penetrate the wall of the production tubing.

When the wall of the production tubing has been penetrated in an overlying zone, communication is established between two different production zones through the failed production tubing string. Communication between zones can be highly undesirable, and isolation between the zones must be maintained. Isolation between the zones in the well bore is generally obtained by the use of packers about the production tubing between production zones. When erosion of production tubing has reached an advanced state, it becomes necessary to replace the eroded section or sections of tubing. This requires removing the production tubing string from the well bore, replacing the failed joints of tubing and reinserting the tubing string into the well bore along with any necessary replacement of packers.

Different tubing materials will erode at different rates and to different degrees depending upon the velocity of the impinging fluid as well as the type and amount of abrasive materials entrained in the fluid. Some materials are considered highly erosion resistant, and various methods have been used to incorporate these materials into the design of the production tubing where the tubing must penetrate overlying production zones. Joints of pipe or tubing have been designed which incorporate a jacket of a highly erosion resistant material, such as tungsten carbide, over the production tubing. Various methods are used to insure that the tungsten carbide will surround the tubing at the areas where the high velocity fluid enters the well bore. The tungsten carbide is generally installed in stacks of relatively short rings and held in place longitudinally by various types of sleeves and collars. In some designs, the rings are kept pressed together by the installation of a spring, such as a coil spring, around the tubing to press against the end of one of the tungsten carbide rings.

A major problem with the use of a highly erosion resistant material, such as tungsten carbide, is that such materials, while being very hard, are also very brittle and therefore subject to damage when placed under radial or axial loads. When making up a tubing string for insertion into a well, it is necessary to support the top joint of the string at the well head and to hold that joint against rotation while threading the next joint to the top joint of the string. Power tongs or similar tools are normally used to thread the two joints together. The top joint of the tubing string is held against rotation while the power tongs rotate the next joint being installed. Such power equipment necessarily bites into the surface of the tubing joint in order to apply the necessary torque to either hold the joint against rotation or to rotate the joint in making up the thread. If such power tools are used on a surface of the blast joint where the erosion resistant material, such as tungsten carbide, is exposed, the torque is not efficiently transferred to the tubing and the tungsten carbide rings can easily become chipped and cracked, resulting in a loss of protection against abrasion once placed into service in a production zone.

Another operation frequently encountered which can result in damage to the tungsten carbide rings is the gripping of a blast joint from above with pipe slips having upwardly canted internal teeth. These teeth must necessarily dig into the surface of the joint to achieve their gripping action in order to pull the blast joint or other piece of equipment out of the well bore. Gripping of a blast joint by such a slip, if the slip teeth contact the tungsten carbide rings, can result in cracking or breaking of the rings as mentioned before in the case of power tongs, by the application of radial or axial forces, through the slip teeth.

Some blast joints, using tungsten carbide rings, incorporate thin metal sleeves on the outside of the tungsten carbide rings, but these sleeves are of insufficient strength to withstand the radial and axial stresses imparted by power tools, and the sleeves typically are not mounted to the inner production tubing with sufficient mechanical strength to transfer the necessary torque or axial force to the tubing itself. These thin sleeves are generally only effective at protecting the tungsten carbide rings during assembly and handling which does not involve the use of the aforementioned power tools.

Another disadvantage of blast joints having exterior carbide rings occurs when the operator wishes to insert the blast joint through a snubber unit. A snubber unit allows a pressurized well to be reworked without first plugging or killing the well. Killing the well is undesirable because it can be difficult and expensive to resume production from a well that has been killed. The snubber unit is mounted on the wellhead of a well which is to be reworked under pressure. The snubber unit establishes and maintains a pressure seal around the tubular goods coming out of or going into the well at the wellhead. It is typically mounted atop one or more blowout preventers. In addition to maintaining the pressure seal, the snubber unit grips any tubular goods being inserted and forces them into the well against the wellhead pressure, which can approach several thousand pounds per square inch. Alternatively, the snubber unit can be used to grip a tubular good being extracted from the well to limit or control its outward movement under wellhead pressure.

This gripping of the tubular goods can be accomplished by pipe slips or other devices which place highly concentrated mechanical loads on the goods being gripped. In addition, the pressure seal can only be effective if applied to a relatively smooth surface which is capable of maintaining its pressure integrity under the pressures experienced at the wellhead. It can be seen, then, that a typical carbide blast joint cannot be inserted into a well with a snubber unit. If this were attempted, the carbide rings would immediately deteriorate or even fail completely, and the pressure seal could not be maintained. A very expensive and dangerous blowout would occur.

U.S. Pat. No. 5,016,921 discloses a blast joint which can be handled as a normal section of production tubing using power tongs, pipe slips, or other power equipment and which can also be used with a snubber unit. The blast joint has a continuous protective sheath of tungsten carbide rings mounted on a specially machined pipe joint. The specially machined pipe joint onto which the carbide rings are mounted adds to the cost and time required to fabricate the blast joints.

A further problem often encountered is a sanded-up well having a blast joint with exterior tungsten carbide rings resting against the wall of the well bore. Typically, a washover assembly having a milling shoe made up on the bottom joint of a washover pipe is lowered into the borehead around the production tubing. The milling shoe is rotated to cut away the obstruction. However, the milling shoe is not capable of cutting through tungsten carbide rings if they are in contact with the wall of the well bore. Thus, it may not be possible to remove the obstruction which may result in the well being shut in and a new well drilled.

It is desirable to design a blast joint which can be fabricated from a standard oilfield pipe joint and which provides protection against erosion for its full length without any gaps. It is further desirable that the blast joint can be handled by the use of power tongs and pipe slips without any unusual degradation of the blast joint and also be used with a snubber unit. It is further desirable to design such a blast joint which can be threaded into place in a production tubing string as if it were simply another joint of production tubing, either as a single joint or as a string of consecutive joints having a continuous protective sheath of tungsten carbide rings without any gaps in between. Additionally, it is further desirable to design such a blast joint which will maintain the erosion resistant rings away from the wall of the well bore.

SUMMARY OF THE PRESENT INVENTION

This invention is a blast joint which can be fabricated from a standard oilfield pipe joint and which provides protection against erosion for its full length without any gaps. The standard oilfield pipe joint minimizes cost and time delays inherent is using specially machined pipe joints. The blast joint exhibits a continuous protective sheath of erosion resistant material for essentially its full length.

The lower end of the blast joint of this invention can be handled using power tongs and provides erosion resistance by using overlapping stacks of erosion resistant rings for its full length. The lower end of the blast joint includes a die driver assembly which mounts to the inner pipe joint with sufficient mechanical strength to transfer the necessary torque or axial force to the inner pipe joint itself. The die driver assembly is mounted to the inner pipe joint utilizing a plurality of dies and wedges. A drive ring forces the wedges against the dies which in turn are driven into the outer surface of the inner pipe joint.

This invention further includes a master assembly at the upper end of the blast joint which incorporates a torque tube suitable for gripping with slip teeth and power tongs. The master assembly is mounted on the inner pipe joint in order to impart thereto the axial and radial loads and torque as required to make up the blast joint of this invention with adjacent tubing joints or blast joints.

The invention further includes a pressure operated piston assembly for maintaining zero clearance between a continuous stack of erosion resistant rings by utilizing the downhole well pressure.

Additionally, the invention further includes a snubbing sleeve which is adapted to connect to the lower end of the torque tube. The snubbing sleeve provides a continuous uniform surface which can be gripped by a snubber unit without gripping or damaging the erosion resistant rings. Centralizer ribs attached to the periphery of the snubbing sleeve and torque tube maintain the erosion resistant rings out of direct contact with the wall of the well bore.

BRIEF DESCRIPTION OF THE DRAWINGS

A better understanding of the invention can be had when the following detailed description of the preferred embodiment is considered in conjunction with the following drawings, in which.

DETAILED DESCRIPTION OF THE INVENTION

Figure 1A:
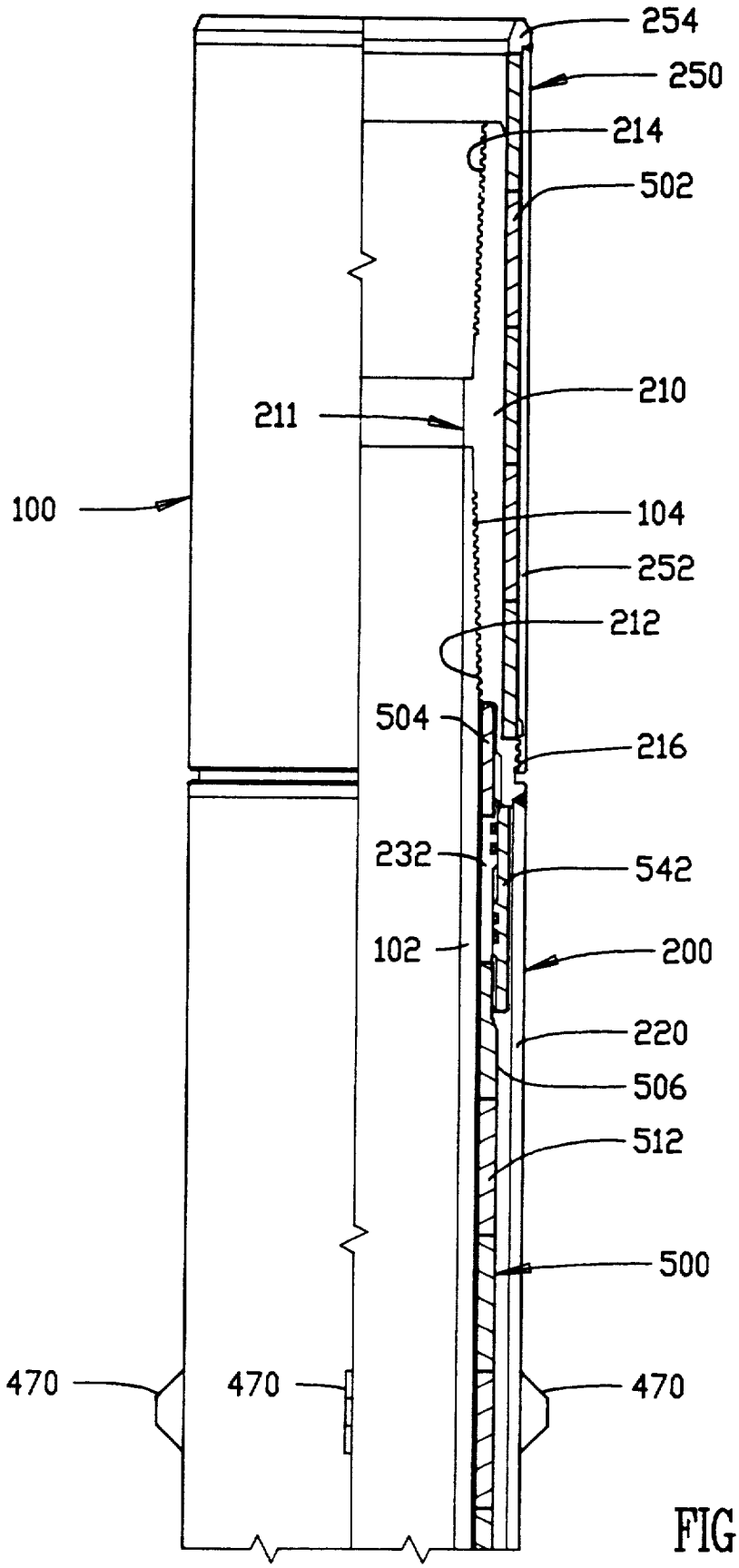
FIGS. 1*a*–1*d* are partial cross-sections of the blast joint of the present invention arranged in end-to-end relationship with FIG. 1*a* showing the upper end and FIG. 1-d the lower end of the blast joint.

A detailed description of the preferred embodiment of the invention will now be given, illustrated in the drawings as applied to a standard type of pipe joint having a uniform outside diameter along the length of the pipe joint, although the invention may also be utilized with upset pipe joints having portions of increased outside diameter, typically at the ends of the pipe joint. It will be understood that this pipe or tubing joint.

Figure 1B:
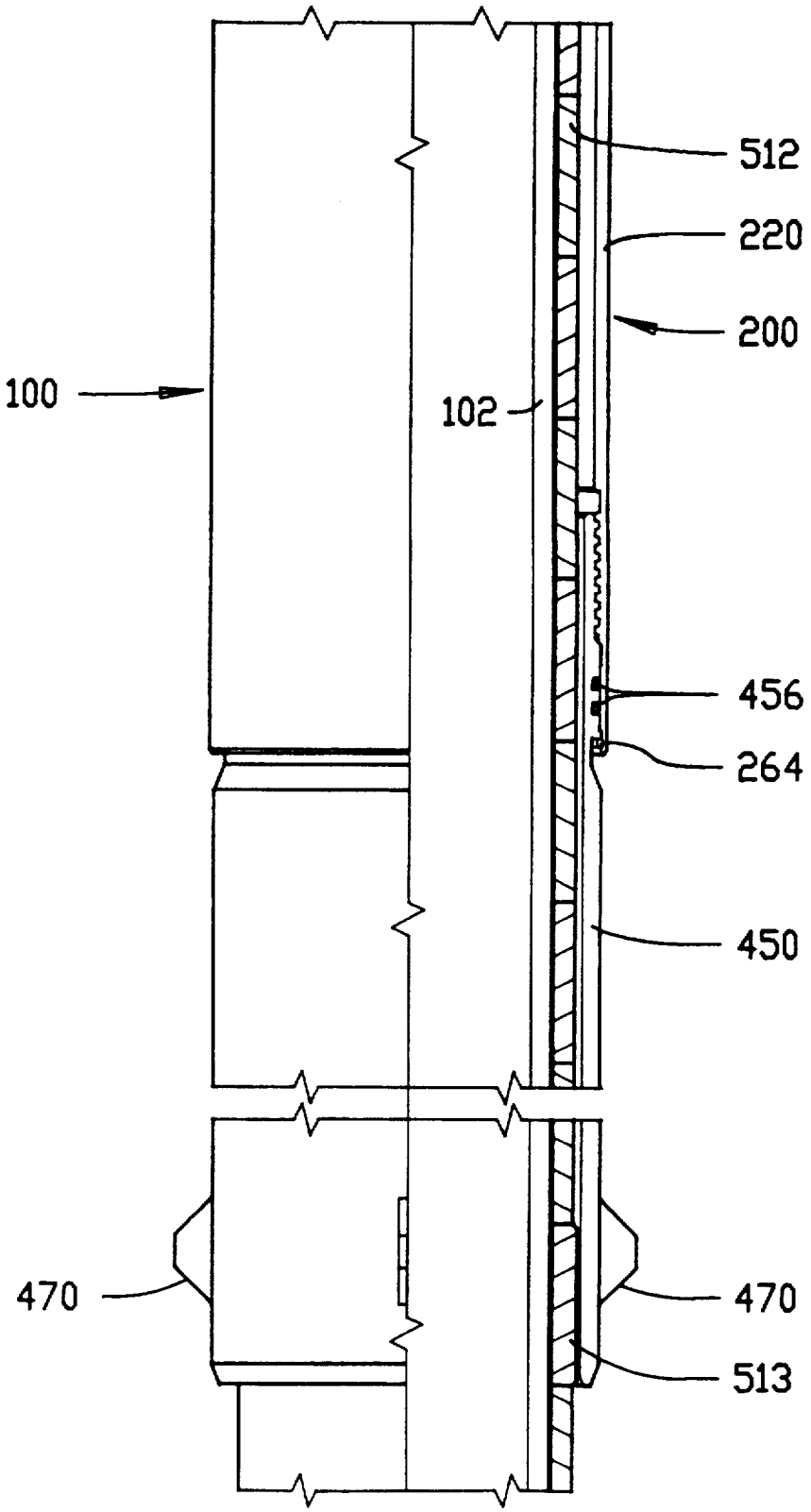
Figure 1C:
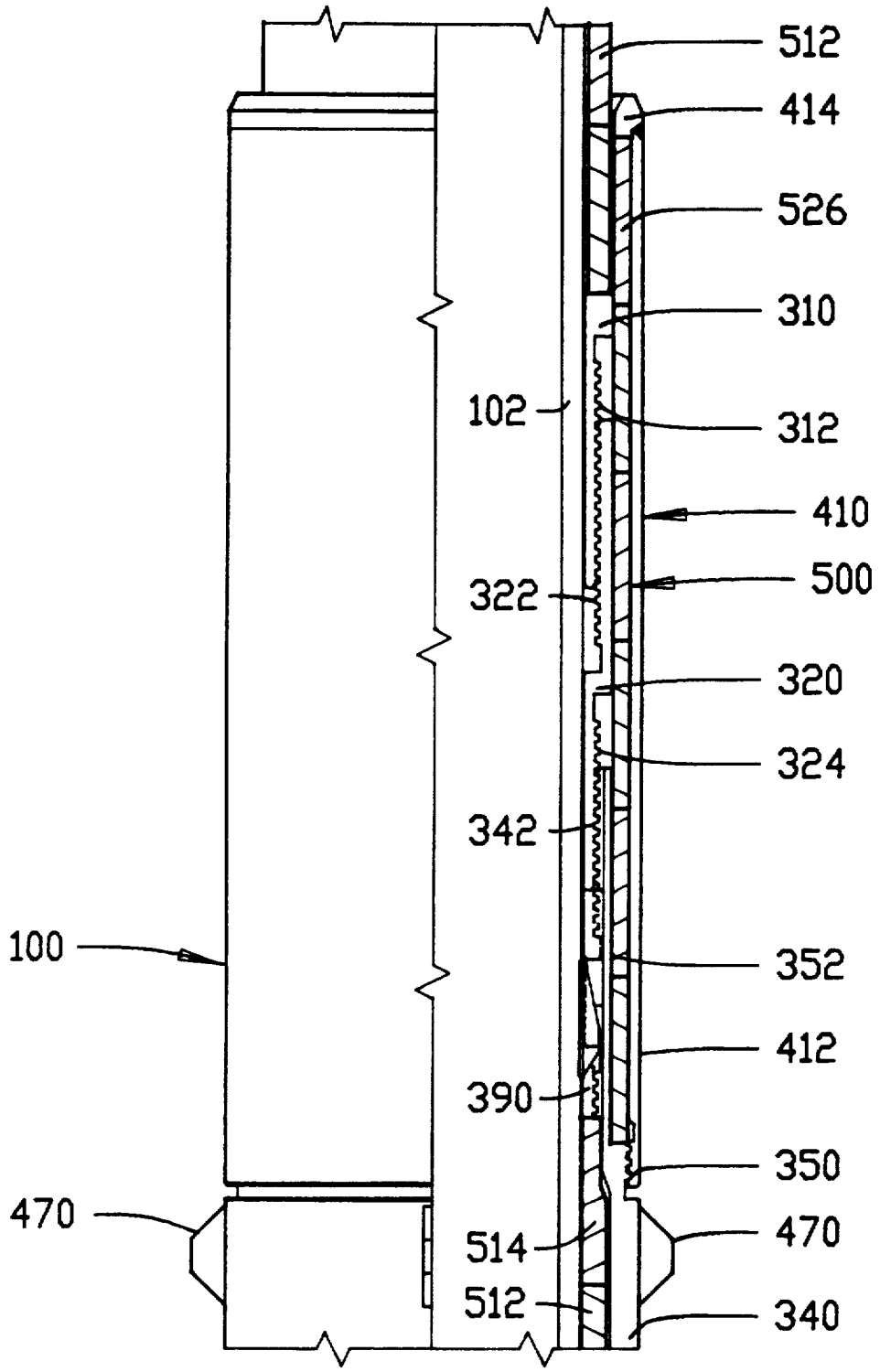
Figure 1D:
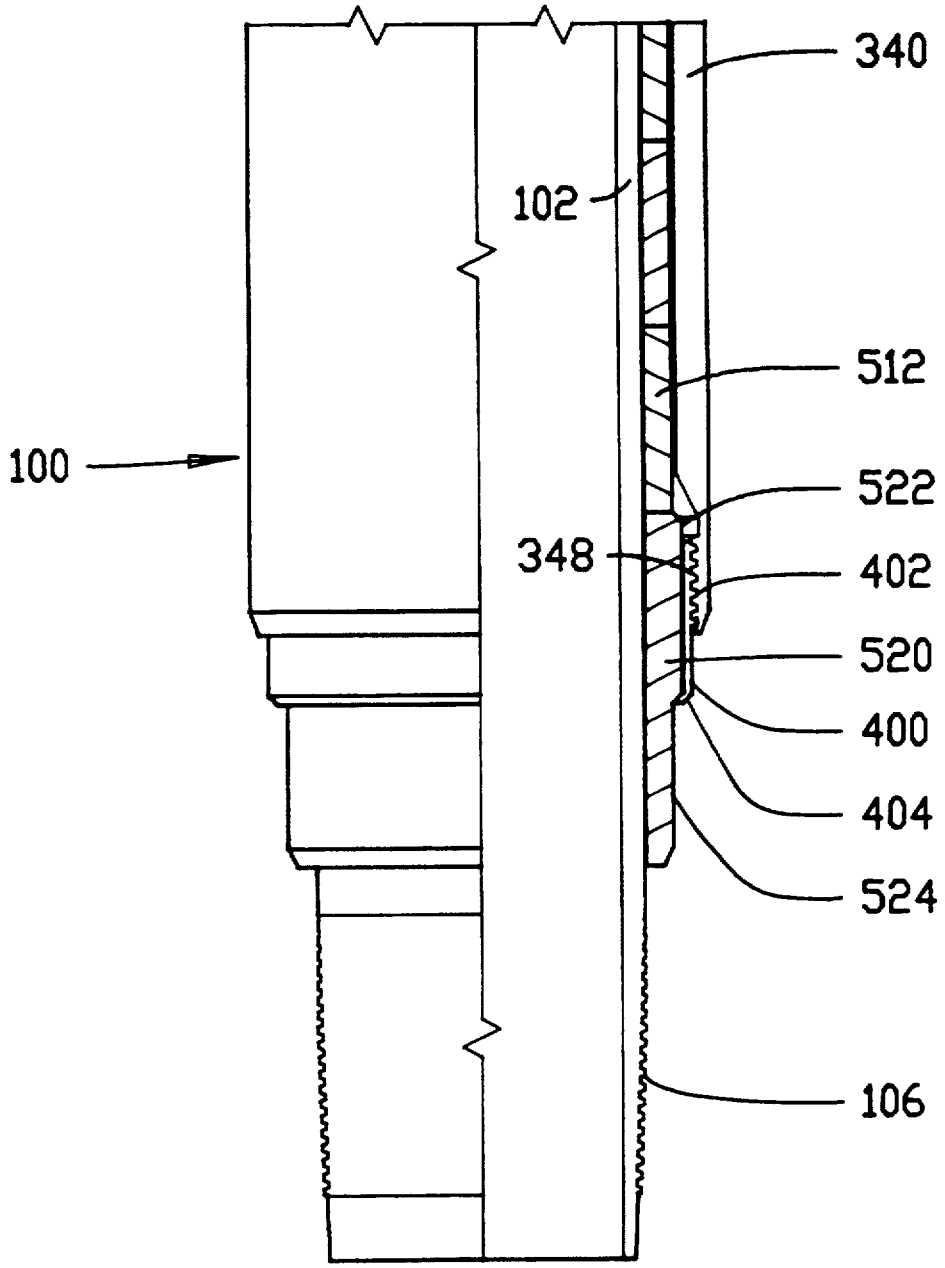

It is also to be understood that FIGS. 1*a*–1*d* are continuous sections of the blast joint of the present invention arranged in end-to-end relationship with FIG. 1*a* showing the upper end and FIG. 1*d* showing the lower end of the blast joint, and with FIGS. 1*b* and 1*c* being upper and lower intermediate sections, respectively.

As shown in FIGS. 1*a*–1*d*, a blast joint, designated generally as 100, incorporates at its innermost diameter an inner pipe joint 102 having an upper threaded pin end 104 (FIG. 1*a*) and a lower threaded pin end 106 (FIG.

1d). Blast protection of this pipe joint 102 is achieved by applying a protective sheath of erosion resistant rings, designated generally as 500, made of a hard material such as tungsten carbide. The erosion resistant rings 500 are arranged in vertical stacks concentric with the inner pipe joint 102 such that successive stacks overlap one another at their ends as shown in FIGS. 1a-1d. The stacks of rings 500 are protected against damage during the handling of the blast joint 100 with various outer housings and assemblies which will be described below.

Referring to FIG. 1a, the upper portion of the blast joint 100 includes a master assembly 200 composed mainly of a master coupling 210 and a torque tube 220. The master coupling 210 includes a through bore 211 having lower internal threads 212 and upper internal threads 214. The lower internal threads 212 engage the upper threaded pin 104 of the blast joint 100. The upper internal threads 214 are provided to join the blast joint 100 with the next uppermost joint of pipe or another blast joint 100. Attached to the lower end of the master coupling 210 is the torque tube 220 which extends downwardly around, and spaced outwardly from, the inner pipe joint 102. The lower end of the master coupling 210 also includes an external threaded portion 216. Threadably attached to the lower end of the master coupling 210 is a top tube 252 of a top housing 250. The top tube 252 extends downwardly around, and spaced outwardly from, the master coupling 210 as shown in FIG. 1a. The annulus between the top tube 252 and the master coupling 210 houses a plurality of erosion resistant coupling rings 502 which are stacked end to end. The upper end of the top housing 250 includes a nose ring 254 attached, preferably by welding, to the upper end of the top tube 252. The nose ring 254 has an inside diameter approximating the inside diameter of the coupling rings 502 to thus provide an upper stop for the coupling rings 502. The top housing 250 is tightly threaded to the master coupling 210 to ensure that no gaps exist between the stacked coupling rings 502.

Figure 2:
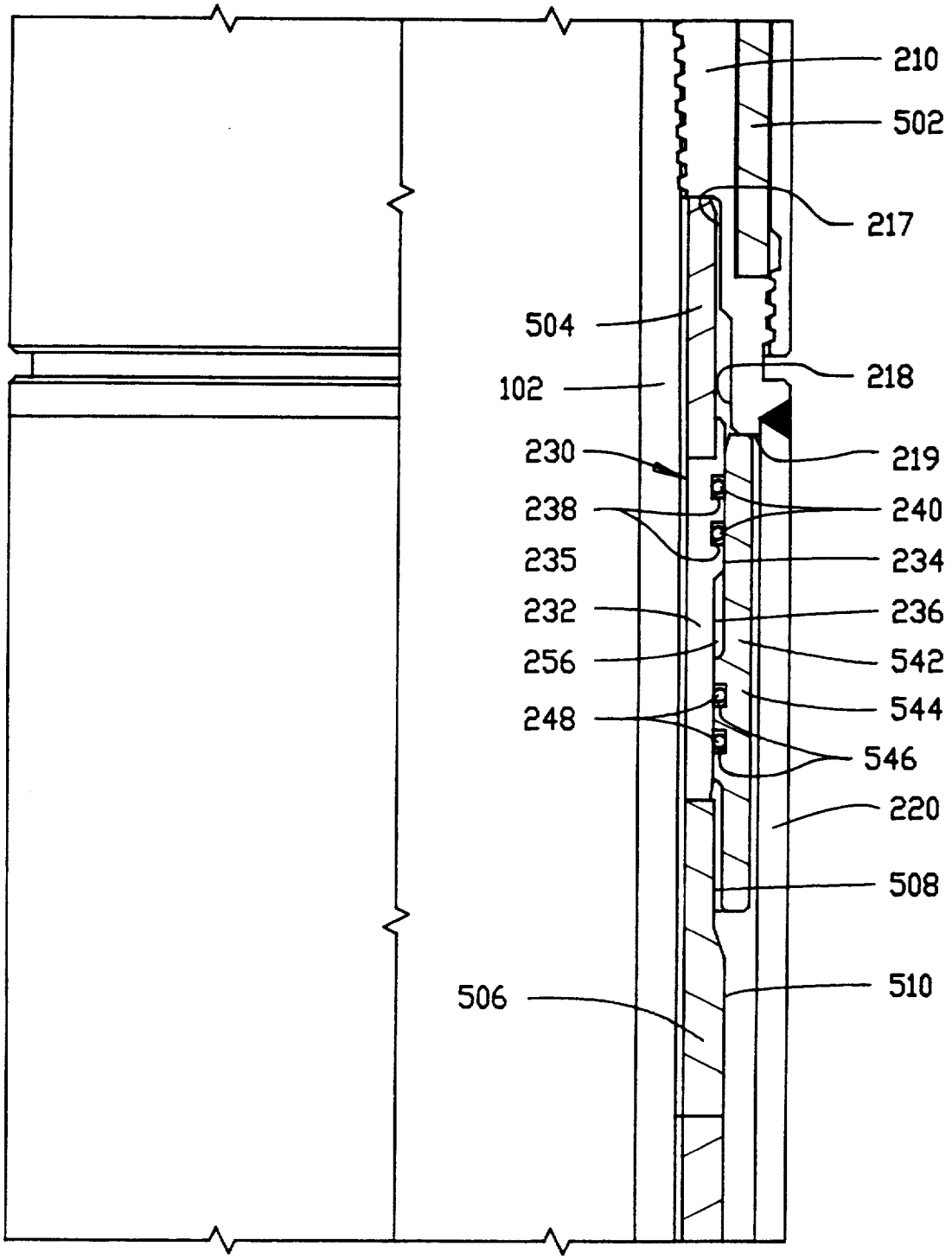
FIG. 2 is an enlarged partial cross-section of the loader piston and cylinder assembly of the upper assembly as shown in FIG. 1*a;*

Referring to FIG. 2, the lower end of the master coupling 210 includes a first step portion 217 and a second step portion 218 providing an annulus between the master coupling 210 and the inner pipe joint 102. A shoulder 219 is formed by the lower end of the master coupling 210 where it joins the torque tube 220. At the upper end of the annulus formed by the step portions 217, 218, the torque tube 220 and the inner pipe joint 102, is a loader piston assembly 230 comprising an upper erosion resistant piston ring 504 and a lower piston ring 232. The upper erosion resistant piston ring 504 is bonded, as for example with epoxy, to the lower piston ring 232. The lower piston ring 232 has a stepped outer surface with the upper portion 234 of the lower piston ring 232 having a greater diameter than the lower portion 236 of the lower piston ring 232. The upper portion 234 of the lower piston ring 232 includes a pair of circumferential recesses 238 for receiving a pair of seals 240. The seals 240 are preferably high temperature O-rings to effectively form a seal between the outer surface of the lower piston ring 232 and an inner surface of a loader cylinder 542 positioned in the annulus between the torque tube 220 and the lower piston ring 232. The loader cylinder 542 is made of an erosion resistant material such as tungsten carbide and has a mid portion 544 having an inside diameter approximating the outside diameter of the lower portion 236 of the lower piston ring 232. The mid portion 544 includes a pair of inner circumferential recesses 546 for receiving a pair of seals 248. The seals 248 are preferably high temperature O-rings to effectively form a seal between the outer surface of the lower piston ring 232 and the inner surface of the loader cylinder 542. A chamber 256 is formed between the upper stepped portion 234 of the lower piston ring 232 and the mid portion 544 of the loader cylinder 542. The chamber 256 is sealed both above and below by the pairs of seals 240 and 248 respectively. The chamber 256 is sealed from the external environment by the series of seals 240, 248. As shown in FIG. 2, the upper piston ring 504 overlaps with the lowermost coupling ring 502 and the loader cylinder 542 to provide a continuous erosion resistant protective sheath along the length of the upper portion of the blast joint 100.

Abutting the lower end of the loader piston assembly 230 is a step ring 506 made of an erosion resistant material such as tungsten carbide. The step ring 506 has a stepped outer surface with an upper portion 508 of the step ring 506 having a smaller diameter than a lower portion 510 of the step ring 506. The upper portion 508 of the step ring 506 is positioned between the lower portion of the loader cylinder 542 and the inner pipe joint 102. The erosion resistant step ring 506 and loader cylinder 542 overlap with one another to provide the continuous protective sheath.

Figure 4:
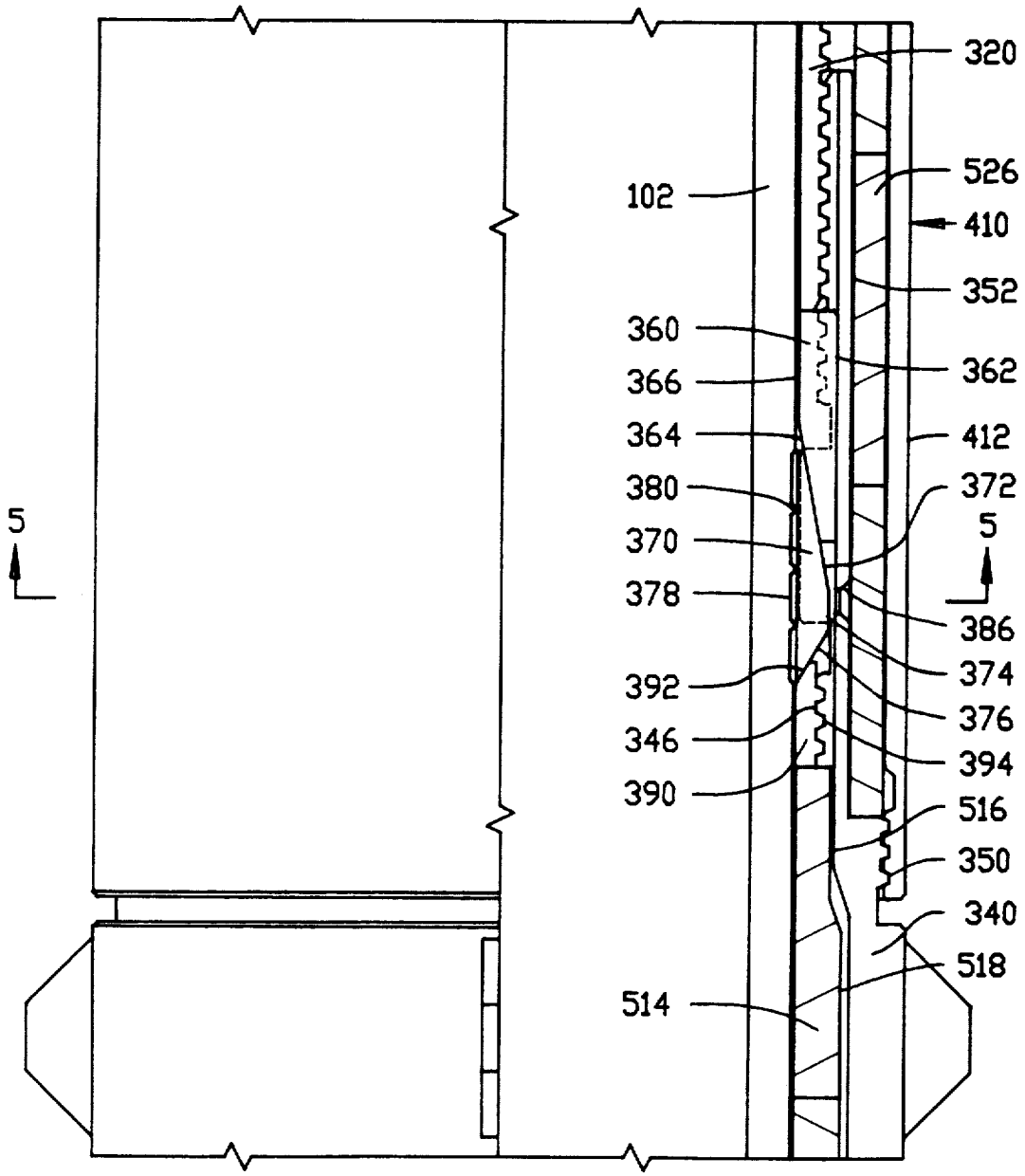
FIG. 4 is an enlarged partial cross-section of the die, wedge, backup ring, drive ring and die driver as shown in FIG. 1*c;*
Figure 5:
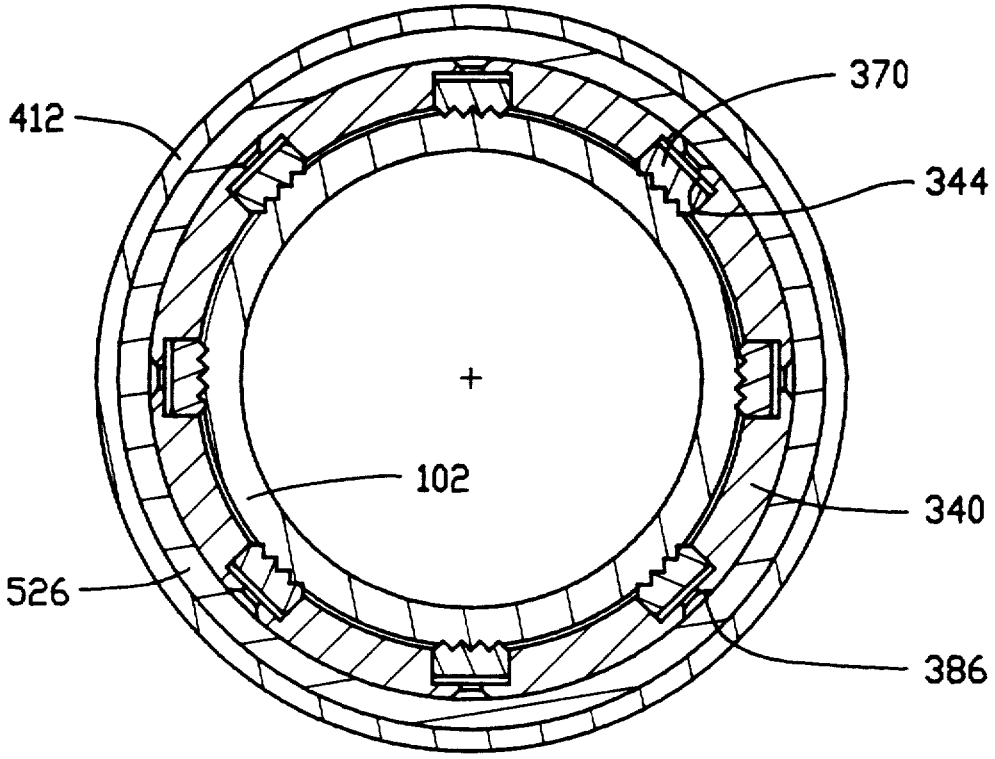
FIG. 5 is a view taken along line 5—5 of FIG. 4.
Figure 6:
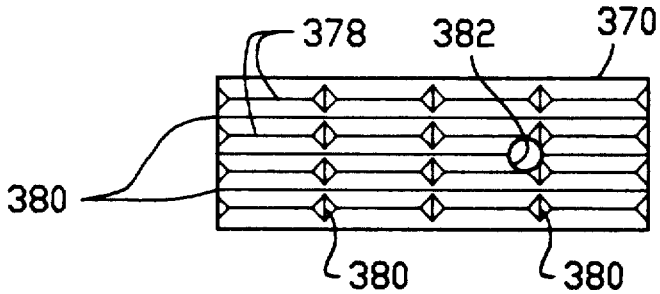
FIG. 6 is a bottom view of the die.
Figure 7:
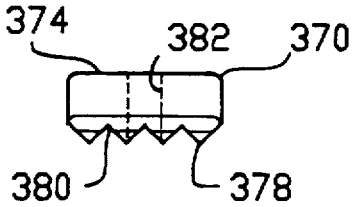
FIG. 7 is an end view of the die.

As shown in FIG. 1a, a plurality of tubing rings 512 are stacked end to end around the inner pipe joint 102 with the uppermost tubing ring 512 abutting the lower end of the step ring 506. As shown in FIG. 1c, the lowermost tubing ring 512 abuts a short spacer 310 having a lower outer threaded portion 312 which threadably engages an upper inner threaded portion 322 of a drive ring 320. The drive ring 320 includes a lower outer threaded portion 324 which threadably engages an upper inner threaded portion 342 of a die driver 340. An annulus is formed between the die driver 340 and the inner pipe joint 102. As best shown in FIG. 4, abutting the lower end of the drive ring 320 are a plurality of wedges 360. The wedges 360 have a generally straight, flat outer surface 362 and a tapered lower inner surface 364 which meets a straight, flat inner surface 366 that is parallel to the outer surface 362. The wedge 360 is at least partially received in a wedge slot 344 formed in the inner surface of the die driver 340 as shown in FIG. 5. The tapered surface 364 of the wedge 360 engages a complementary tapered outer surface 372 of a die 370. Adjoining the tapered outer surface 372 is a flat outer surface 374 which meets with a downwardly tapered surface 376. An inner surface 378 of the die 370 as shown in FIGS. 6 and 7 has a plurality of intersecting v-grooves 380 cut into the inner surface 378. The inner surface 378 of the die 370 is driven into the outer surface of the inner pipe joint 102 and provides the gripping action required for the transfer of torque to the inner pipe joint 102 as will be explained below in detail.

The flat outer surface 374 of the die 370 has a bore 382 extending into the die 370. As shown in FIG. 7, the bore 382 extends through the die 370, although it is not necessary that the bore 382 extend through the die 370. The bore 382 receives a shearing member (not shown) such as a plastic or brass shear bolt or flat head screw which is inserted through a countersunk hole 386 in the die driver 340 as shown in FIGS. 4 and 5. The shearing member facilitates the assembly of the blast joint 100 as will be explained below.

As shown in FIG. 4, the downwardly tapered surface 376 of the die 370 abuts a tapered surface 392 of a backup ring 390. The backup ring 390 has a threaded outer surface 394 which threadably engages a short inner threaded portion 346 of the die driver 340. The lower end of the backup ring 390 abuts a second step ring 514 made of an erosion resistant material such as tungsten carbide. The step ring 514 has a stepped outer surface with an upper portion 516 of the step ring 514 having a smaller diameter than a lower portion 518 of the step ring 514. Referring to FIGS. 1*c* and 1*d*, a plurality of tubing rings 512 are stacked end to end with the uppermost ring 512 abutting the lower end of the step ring 514 and the lowermost ring 512 abutting an erosion resistant bottom ring 520. The bottom ring 520 includes a stepped outer surface with an upper portion 522 of the bottom ring 520 having a greater diameter than a lower portion 524 of the bottom ring 520.

It is to be noted that the erosion resistant piston ring 504, the upper step ring 506, the tubing rings 512, the lower step ring 514, and the bottom ring 520 have the same inside diameter which closely conforms to the outside diameter of the inner pipe joint 102 around which they are stacked. The vertical length of the erosion resistant rings 500 can be varied as desired, with a standard length being between one and a half to two and a half inches.

Referring to FIG. 1*d*, the lower end of the die driver 340 has an internal threaded portion 348 which engages an external threaded portion 402 of a ring holder 400. The ring holder 400 has an inwardly projecting lip 404 which firmly engages the step portion of the bottom ring 520.

As shown in FIGS. 1*c*, 1*d* , and 4, the die driver 340 has a uniform lower outer surface which extends upward to a point adjacent the lower step ring 514. The die driver 340 has an inside diameter such that the die driver 340 surrounds the lower stack of tubing rings 512 and the lower step ring 514. The uniform lower outer surface of the die driver 340 steps down to a short outer threaded portion 350 before stepping down even further to a reduced uniform outer surface 352. Threadably attached to the short outer threaded portion 350 is a bottom tube 412 of a bottom housing 410. The bottom tube 412 extends downwardly around, and spaced outwardly from, the reduced uniform outer surface 352 of the die driver 340 and the drive ring 320. The annulus between the bottom tube 412 and the reduced uniform outer surface 352 of the die driver 340 and the drive ring 320 houses a plurality of erosion resistant bottom coupling rings 526 which are stacked end to end. Referring to FIG. 1*c*, the upper end of the bottom housing 410 includes a bottom nose ring 414 attached, preferably by welding, to the upper end of the bottom tube 412. The bottom nose ring 414 has an inside diameter approximating the inside diameter of the bottom coupling rings 526 to thus provide an upper stop for the stack of bottom coupling rings 526. The bottom housing 410 is tightly threaded to the die driver 340 to ensure that no gaps exist between the bottom coupling rings 526.

As shown in FIG. 1*c*, the continuous stack of bottom coupling rings 526 overlaps with the lowermost tubing ring 512 and the lower step ring 514 to provide a continuous sheath of erosion resistant rings for the length of the inner pipe joint 102.

In use, the blast joint 100 utilizes the downhole well pressure to hydrostatically apply a downward force on the stack of erosion resistant rings 500 and the lower piston ring 232 positioned between the master coupling 210 and the short spacer 310, thus eliminating any gaps between the erosion resistant rings 500 and the lower piston ring 232 in the stack. The hydrostatic driving force is necessary because of possible shifts of the blast joint protective sheath during handling and operation and also because of the difference in the coefficients of thermal expansion of the materials forming the inner pipe joint 102 and the erosion resistant rings 500.

In use, the downhole well pressure fills the annulus between the inner pipe joint 102 and the torque tube 220 up to the first step portion 217 of the master coupling 210. The pressure in the chamber 256 is sealed off from the well pressure and remains essentially at ambient pressure. As can be seen in FIG. 2, the well pressure results in an upward force acting on the loader cylinder 542 forcing the loader cylinder 542 in the direction of the master coupling 210. The well pressure in the annular area above the loader cylinder 542 results in a downward force on the exposed surface of the upper end of the upper piston ring 504 and the upper exposed end of the lower piston ring 232. The well pressure acting on the loader piston assembly 230 and the loader cylinder 542 decreases the size of the annular chamber 256 by moving the seals 240 and 248 toward each other. The downward movement of the loader piston assembly 230 eliminates any slack between the stack of erosion resistant rings 500. This longitudinal movement of the loader piston assembly 230 relative to the loader cylinder 542 occurs because the well pressure acting on the outside end surfaces of the annular chamber 256 multiplied by the effective area of those surfaces is greater than the ambient pressure inside the chamber 256 multiplied by the area of the upper and lower end of the chamber 256. The pressure inside the chamber 256 can increase slightly because of the reduction in volume of the chamber 256 and because of the increase in temperature, but it will never approach the well pressure which can be several thousand pounds per square inch.

Figure 3:
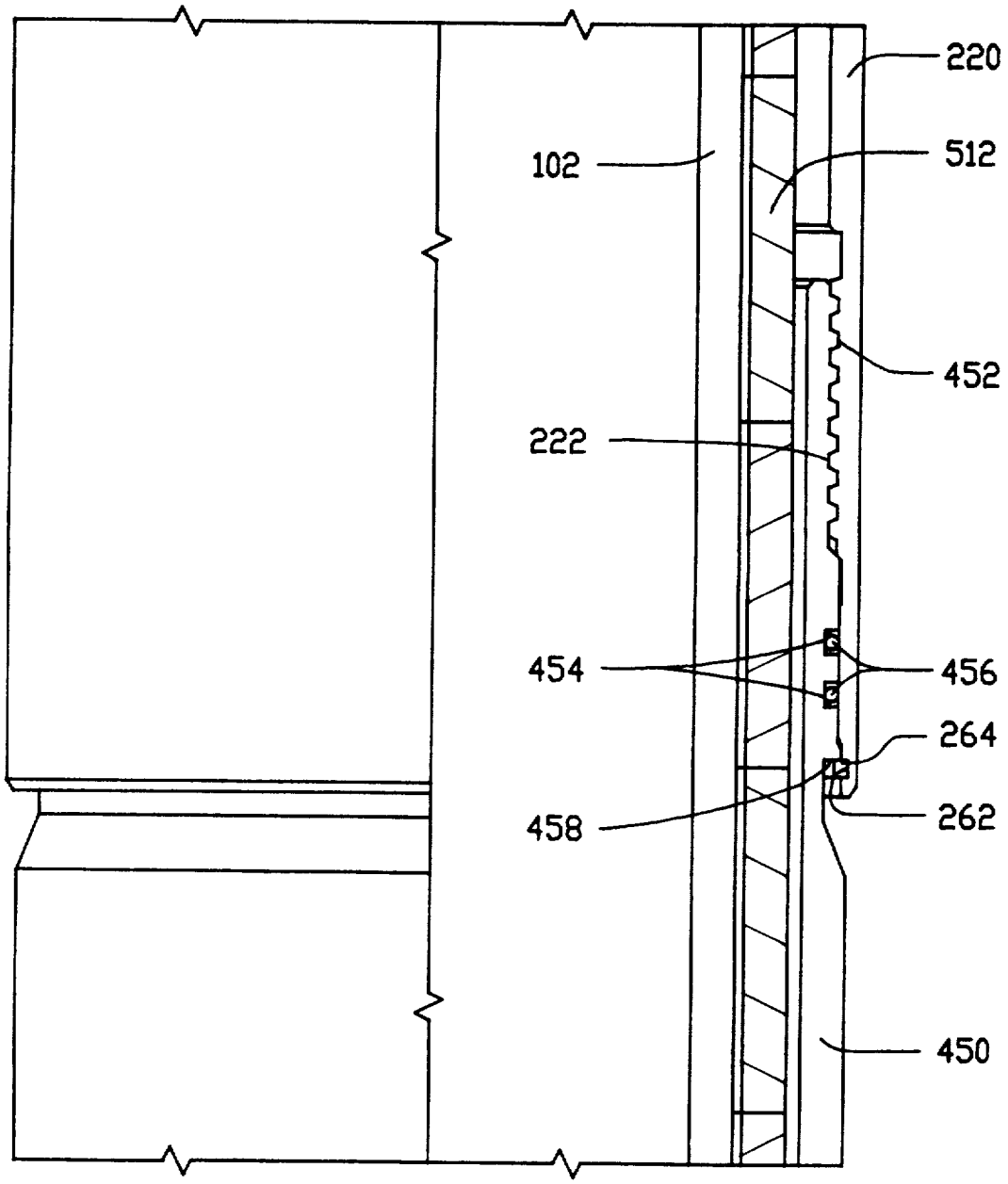
FIG. 3 is an enlarged partial cross-section of the attachment of the snubbing sleeve of the master assembly as shown in FIG. 1*b;*

In order the make the blast joint 100 adaptable for use with a snubber unit, a snubbing sleeve 450 having a smooth, continuous exterior surface is used along the mid-section of the blast joint 100 between the master assembly 200 and the bottom housing 410 as shown in FIG. 1*b*. The snubbing sleeve 450 is connected to the torque tube 220 of the master assembly 200 as shown in FIGS. 1*b* and 3. The torque tube 220 has lower internal threads 222 engaging external threads 452 of the snubbing sleeve 450. Below the external threads 452 are a pair of circumferential recesses 454 for receiving a pair of seals 456. The seals 456 are preferably high temperature O-rings to effectively form a seal between the outer surface of the snubbing sleeve 450 and the inner surface of the torque tube 220. The snubbing sleeve 450 includes a shoulder 458 below the lowermost circumferential recess 454. The bottom end of the torque tube 220 includes an inner circumferential lock ring groove 262 which receives a lock ring 264. The lock ring 264 will abut the shoulder 458 of the snubbing sleeve 450 and prevent the unthreading of the snubbing sleeve 450 from the torque tube 220. Thus, the lock ring 264 will prevent the snubbing sleeve 450 from being unthreaded during an operation in which it may be necessary to cut off centralizer ribs as described below.

Referring to FIGS. 1*a* and 1*b*, a plurality of centralizer ribs 470 may be spaced around the periphery of the snubbing sleeve 450 and the torque tube 220 to maintain the erosion resistant rings 500 away from the wall of the well bore. This will ensure that a washover assembly will be able to pass by the blast joint 100, if necessary, since the rotating milling shoe will not have to attempt to cut through a tungsten carbide ring which is in contact with the wall of the well bore, but instead can cut off the centralizer ribs 470 which are made of a softer material. Additional centralizer ribs 470 are also shown in FIG. 1*c* attached to the outer periphery of the die driver 340.

As shown in FIG. 1*b*, an erosion resistant centering ring 513 having an outer diameter slightly greater than the tubing rings 512 is positioned in the stack of tubing rings 512 near the lower end of the snubbing sleeve 450 to maintain the snubbing sleeve 450 and the torque tube 220 centered about the inner pipe joint 102.

Assembly

The assembly of the blast joint 100 will now be described. The assembly procedure will begin at the upper end of the blast joint 100 and proceed to the lower end.

Referring to FIG. 1*a*, a plurality of tubing rings 512 are installed over the upper end of the inner pipe joint 102. The number of tubing rings 512 should be enough to extend approximately to the projected bottom of the torque tube 220 or snubbing sleeve 450, if desired. The upper step ring 506 is then inserted over the upper end of the inner pipe joint 102. Referring to FIG. 2, the upper piston ring 504 is bonded to the lower piston ring 232 with adhesive, as for example, epoxy, to form the loader piston assembly 230. The pair of seals 240 are inserted in the pair of circumferential recesses 238 in the lower piston ring 232. The pair of seals 248 are inserted in the pair of inner circumferential recesses 546 of the loader cylinder 542. The lower piston ring 232 is then slid into the loader cylinder 542. The loader piston assembly 230 and the loader cylinder 542 are then inserted over the upper end of the inner pipe joint 102. The master assembly 200, including the torque tube 220 and master coupling 210, is then inserted over the upper end of the inner pipe joint 102 and around the tubing rings 512, step ring 506, loader cylinder 542 and loader piston assembly 230. The master coupling 210 is threaded onto the upper pin 104 of the inner pipe joint 102.

As shown in FIG. 1*a*, five coupling rings 502 are inserted in the top housing 250 such that the uppermost coupling ring 502 abuts the nose ring 254. The top housing 250 is then threaded to the external threaded portion 216 of the master coupling 210. The top tube 252 is fully threaded onto the master coupling 210 so that no gaps exist between the coupling rings 502.

As shown in FIG. 1*b* and 3, the snubbing sleeve 450 is installed by inserting the seals 456 in the circumferential recesses 454 in the snubbing sleeve 450. The snubbing sleeve 450 is threaded into the lower end of the torque tube 220. The lock ring 264 is then installed in the lock ring groove 262.

Referring to FIGS. 1*c*, 1*d*, and 4, the assembly of the lower end of the blast joint 100 is performed by installing the dies 370 in the die driver 340 with the shear members inserted through the countersunk holes 286 in the die driver 340 before being received by the bores 382 in the dies 370. The wedges 360 are then pushed up against the dies 370 as shown in FIG. 4. The drive ring 320 is threaded into the upper end of the die driver 340 until the lower end of the drive ring 320 edges up against the wedges 360. The short spacer 310 (FIG. 1*c*) is then threaded entirely onto the drive ring 320. The backup ring 390 is installed in the die driver 340 from the lower end of the die driver 340. The backup ring 390 (FIG. 4) is threaded into the die driver 340 until the backup ring 390 contacts the dies 370. The lower step ring 514, three tubing rings 512 and the bottom ring 520 are then inserted into the die driver 340 from the lower end of the die driver 340. The ring holder 400 (FIG. 1*d*) is firmly threaded into the lower end of the die driver 340 so that the lower step ring 514, the tubing rings 512 and the bottom ring 520 are firmly secured against the backup ring 390.

As shown in FIG. 1*c*, six bottom coupling rings 526 are inserted in the bottom housing 410. The bottom housing 410 is slid onto the lower end of the inner pipe joint 102 to a point where it is adjacent to the snubbing sleeve 450, if the snubbing sleeve 450 is being used. The die driver assembly is then slid onto the lower end of the inner pipe joint 102 until the bottom ring 520 (FIG. 1*d*) is approximately ¼" above the top of the lower threaded pin 106. A backup wrench is put on the outer surface of the die driver 340 and a make up wrench is applied to the outer surface of the drive ring 320. The drive ring 320 is torqued to approximately 1,500 to 2,000 foot-pounds which drives the wedges 360 against the dies 370, shearing the shear members, thus setting the dies 370 into the outer surface of the inner pipe joint 102. The short spacer 310 (FIG. 1*a*) is rotated to partially unthread the short spacer 310 thus eliminating any gaps between the upper stack of tubing rings 512. The bottom housing 410 is then slid down over the short spacer 310 and the drive ring 320 until it threadably engages the die driver 340. The blast joint 100 is now fully assembled.

The description given herein is intended to illustrate the preferred embodiments of the present invention. It is possible for one skilled in the art to make various changes to the details of the apparatus without departing from the spirit of this invention. Therefore, it is intended that all such variations be included within the scope of the present invention.

I claim:

1. A blast joint resistant to erosion, comprising:

an inner pipe joint having a smooth cylindrical outer surface and an upper end and a lower end;

a cylindrical lower assembly mounted on said lower end of said inner pipe joint, said lower assembly having an exterior surface suitable for gripping with power tongs;

means for transferring torque from said lower assembly to said smooth outer surface of said inner pipe joint;

a cylindrical upper assembly mounted on said upper end of said inner pipe joint, said upper assembly comprising:

a master coupling threadably engaging said upper end of said inner pipe joint; and a torque tube attached to said master coupling and extending around said inner pipe joint, said torque tube providing an outer surface suitable for gripping with power tongs and pipe slips;

a plurality of erosion resistant rings concentrically mounted on said inner pipe joint in a vertically continuous arrangement from a point near said lower end to a point near said upper end of said inner pipe joint without a vertical gap between said rings; and means for imposing a vertical load on said plurality of rings to prevent separations between said rings.

2. The blast joint of claim 1, wherein said torque transferring means comprises:

a plurality of dies positioned within said lower assembly and around said lower end of said inner pipe joint, said dies having a first surface for engaging said outer surface of said inner pipe joint, wherein said dies drivably engage said outer surface of said inner pipe joint.

3. A blast joint resistant to erosion, comprising:

an inner pipe joint having a smooth cylindrical outer surface and an upper end and a lower end;

a cylindrical lower assembly mounted on said lower end of said inner pipe joint, said lower assembly having an exterior surface suitable for gripping with power tongs;

means for transferring torque from said lower assembly to said smooth cylindrical outer surface of said inner pipe joint, said means for transferring torque including a plurality of dies positioned within said lower assembly and around said lower end of said inner pipe joint, said dies having a first surface for engaging said smooth cylindrical outer surface of said inner pipe joint and a ramped second surface, wherein said dies drivably engage said smooth cylindrical outer surface of said inner pipe joint;

a cylindrical upper assembly mounted on said upper end of said inner pipe joint, said upper assembly having an exterior surface suitable for gripping with power tongs;

a plurality of erosion resistant rings concentrically mounted on said inner pipe joint in a vertically continuous arrangement from a point near said lower end to a point near said upper end of said inner pipe joint without a vertical gap between said rings; and means for imposing a vertical load on said plurality of rings to prevent separations between said rings;

wherein said lower assembly comprises:

a die driver having an inside diameter greater than the outside diameter of said inner pipe joint, said die driver having a plurality of longitudinal slots;

a plurality of wedges wherein each wedge has a ramped surface corresponding to said ramped second surface of said dies, each wedge being positioned in said longitudinal slot in said die driver; and a drive ring threadably engaging said die driver, said drive ring abuts said wedges and forces said wedges against said dies such that said first surface of said dies drivably engage said outer surface of said inner pipe joint.

4. The blast joint of claim 3, wherein said lower assembly comprises:

a bottom housing which threadably engages said die driver; and a plurality of erosion resistant bottom coupling rings vertically stacked in said bottom housing, wherein said bottom housing and said bottom coupling rings surround said inner pipe joint.

5. The blast joint of claim 4, wherein said plurality of erosion resistant rings includes a continuous stack of rings extending from said load imposing means to said lower assembly, the blast joint further comprising a short spacer having a lower end threadably engaging said drive ring and an upper end abutting said lowermost ring in said continuous stack of rings, wherein said short spacer is tightened against said continuous stack of rings so that no vertical gaps exist between said rings.

6. A blast joint resistant to erosion, comprising:

an inner pipe joint having a smooth cylindrical outer surface and an upper end and a lower end;

a cylindrical lower assembly mounted on said lower end of said inner pipe joint, said lower assembly having an exterior surface suitable for gripping with power tongs;

means for transferring torque from said lower assembly to said smooth cylindrical outer surface of said inner pipe joint;

a cylindrical upper assembly mounted on said upper end of said inner pipe joint, said upper assembly having an exterior surface suitable for gripping with power tongs, said upper assembly comprising:

a master coupling threadably engaging said upper end of said inner pipe joint; and a torque tube attached to said master coupling and extending around said inner pipe joint such that an annulus is formed between said torque tube and said inner pipe joint, said torque tube providing an outer surface suitable for gripping with power tongs and pipe slips;

a plurality of erosion resistant rings concentrically mounted on said inner pipe joint in a vertically continuous arrangement from a point near said lower end to a point near said upper end of said inner pipe joint without a vertical gap between said rings; and means for imposing a vertical load on said plurality of rings to prevent separations between said rings, said load imposing means comprises:

a loader piston arranged concentrically with said inner pipe joint and located at the upper end of said annulus formed between said torque tube and said inner pipe joint; and a loader cylinder concentrically mounted onto said loader piston and forming a sealed annular chamber between said loader cylinder and said loader piston, wherein said sealed annular chamber is maintained at a relatively low pressure with respect to the pressure outside the annular chamber creating a pressure differential which produces a force acting downward on said loader piston and said plurality of rings below said loader piston.

7. A blast joint resistant to erosion, comprising:

an inner pipe joint having a smooth cylindrical outer surface and an upper end and a lower end;

a cylindrical lower assembly mounted on said lower end of said inner pipe joint, said lower assembly having an exterior surface suitable for gripping with power tongs;

means for transferring torque from said lower assembly to said smooth cylindrical outer surface of said inner pipe joint;

a cylindrical upper assembly mounted on said upper end of said inner pipe joint, said upper assembly having an exterior surface suitable for gripping with power tongs, said upper assembly comprising:

a master coupling threadably engaging said upper end of said inner pipe joint; and a torque tube attached to said master coupling and extending around said inner pipe joint, said torque tube providing an outer surface suitable for gripping with power tongs and pipe slips;

a plurality of erosion resistant rings concentrically mounted on said inner pipe joint in a vertically continuous arrangement from a point near said lower end to a point near said upper end of said inner pipe joint without a vertical gap between said rings;

means for imposing a vertical load on said plurality of rings to prevent separations between said rings; and a snubbing sleeve attached to said lower end of said torque tube and extending downwardly around said inner pipe and outside said plurality of erosion-resistant rings.

8. A blast joint resistant to erosion, comprising:

an inner pipe joint having a smooth cylindrical outer surface, a first end and a second end;

a first assembly mounted on said first end of said inner pipe joint;

a second assembly mounted on said smooth cylindrical outer surface of said second end of said inner pipe joint;

a plurality of erosion resistant rings concentrically stacked around said outer surface of said inner pipe joint between said first and second assemblies; and means for transferring torque from said second assembly to said smooth outer surface of said inner pipe joint, said torque transferring means comprises a plurality of dies slidably positioned interiorly within said second assembly and around said second end of said inner pipe joint, said dies having a first surface for engaging said outer surface of said inner pipe joint, wherein said dies drivably engage said outer surface of said inner pipe joint.

9. A blast joint resistant to erosion, comprising:

an inner pipe joint having a smooth cylindrical outer surface, a first end and a second end;

a first assembly mounted on said first end of said inner pipe joint;

a second assembly mounted on said smooth cylindrical outer surface of said second end of said inner pipe joint;

a plurality of erosion resistant rings concentrically stacked around said outer surface of said inner pipe joint between said first and second assemblies;

means for transferring torque from said second assembly to said smooth outer surface of said inner pipe joint, said means for transferring torque comprises a plurality of dies positioned within said second assembly and around said second end of said inner pipe joint, said dies having a first surface for engaging said outer surface of said inner pipe joint and a ramped second surface, wherein said dies drivably engage said outer surface of said inner pipe joint;

wherein said second assembly comprises:

a die driver having an inside diameter greater than the outside diameter of said inner pipe joint, said die driver having a plurality of longitudinal slots;

a plurality of wedges wherein each wedge has a ramped surface corresponding to said ramped second surface of said dies, each wedge being positioned in said longitudinal slot in said die driver; and a drive ring threadably engaging said die driver, said driver ring abuts said wedges and forces said wedges against said dies such that said first surface of said dies drivably engage said outer surface of said inner pipe joint.

10. The blast joint of claim 9, wherein said second assembly comprises:

a bottom housing which threadably engages said die driver; and a plurality of erosion resistant bottom coupling rings vertically stacked in said bottom housing, wherein said bottom housing and said bottom coupling rings surround said inner pipe joint.

11. The blast joint of claim 9, further comprising means for imposing a vertical load on said plurality of rings to prevent separations between said rings.

12. A mechanical connector for transferring torsional loads to a smooth cylindrical outer surface of an inner pipe joint in a blast joint, comprising:

a cylindrical assembly surrounding the outer surface of the inner pipe joint;

a plurality of dies positioned within said cylindrical assembly and around the outer surface of the inner pipe joint, said dies having a first surface for engaging the outer surface of the inner pipe joint and a ramped second surface;

means for engaging said first surface of said dies against the outer surface of the inner pipe joint;

wherein said cylindrical assembly comprises:

a die driver having an inside diameter greater than the outside diameter of the inner pipe joint, said die driver having a plurality of longitudinal slots;

a plurality of wedges wherein each wedge has a ramped surface corresponding to said ramped second surface of said dies, each wedge being positioned in said longitudinal slot in said die driver; and a driver ring threadably engaging said die driver, said drive ring abuts said wedges and forces said wedges against said dies such that said first surface of said dies drivably engage the outer surface of the inner pipe joint.

* * * * *

UNITED STATES PATENT AND TRADEMARK OFFICE

CERTIFICATE OF CORRECTION

PATENT NO. : 5,275,441

DATED : January 4, 1994

INVENTOR(S) : Jack R. Claycomb

It is certified that error appears in the above-identified patent and that said Letters Patent is hereby corrected as shown below:

At column 3, line 28, change "borehead" to --borehole--.

At column 4, line 58, after "this", insert --invention can easily be adapted to any size or type of--.

At column 8, line 31, after "end", insert --surfaces--.

Signed and Sealed this

Seventeenth Day of May, 1994

Bruce Lehman

*Attest:*

BRUCE LEHMAN

*Attesting Officer*

*Commissioner of Patents and Trademarks*